US005439538A

United States Patent [19]

Perry

[11] Patent Number: 5,439,538

[45] Date of Patent: Aug. 8, 1995

[54] DECORATIVE ARTICLE AND METHOD FOR MAKING THE SAME

[76] Inventor: Gayle E. Perry, 3915 N. Park Ave., Studio #1, Tucson, Ariz. 85719

[21] Appl. No.: 56,116

[22] Filed: Apr. 30, 1993

[51] Int. Cl.[6] ..... B44F 7/00

[52] U.S. Cl. ..... 156/63; 156/299; 156/300; 428/24; 428/79

[58] Field of Search ..... 428/79, 102, 24, 7; 156/63, 299, 300; 206/575; 434/94

[56] References Cited

U.S. PATENT DOCUMENTS

| | | | |
|---|---|---|---|
| 2,291,935 | 8/1942 | Woodall et al. | 428/102 X |
| 2,749,640 | 6/1956 | Scott | 428/43 |
| 3,016,317 | 1/1962 | Brunner | 428/138 |
| 3,240,176 | 3/1966 | Morrison | 428/906.6 X |
| 3,392,078 | 7/1968 | Duhl | 428/102 X |
| 3,553,062 | 1/1971 | Berlin | 428/21 |
| 3,570,435 | 3/1971 | Morrison | 428/16 X |
| 3,758,358 | 9/1973 | Kuroda | 428/79 X |
| 4,514,175 | 4/1985 | Zaruba et al. | 428/79 X |

FOREIGN PATENT DOCUMENTS

| | | | |
|---|---|---|---|
| 1042209 | of 0000 | Canada | 156/63 |

*Primary Examiner*—Henry F. Epstein
*Attorney, Agent, or Firm*—Marshall & Melhorn

[57] ABSTRACT

A decorative article and a means for making such a decorative article includes a wood base, a layer of polyethylene foam, batting, and a fabric outer surface. In forming the decorative article, a layer of polyethylene foam is adhered to a firm backing. A pattern is drawn or traced onto the outer surface of the foam. A number of smaller, pattern pieces are formed by cutting a number of slits in the foam along the lines of the pattern. After the slits have been cut in the foam, the pattern pieces are covered by batting and a knit material to form the desired pattern. Different colors may be selected for the knit materials used on various pattern pieces for the drawing. The foam must have sufficient elasticity to permit the slits to be cut in the surface and then have the slits serve as a means for securing the batting and the knit material used to cover the pattern pieces. The decorative article is divided into a number of pattern pieces to facilitate the stretching of the fabric and the smoothing of the outer surface. In order to achieve a three-dimensional effect, the foam surface may be sculpted by cutting and trimming the foam prior to installing. Individual pieces of foam may be sculpted to the desired shape and then are attached to the surface of the foam. The batting and the material are stretched over the pattern pieces and secured in the slits by the elastic resistance of the foam walls of the slit.

8 Claims, 2 Drawing Sheets

DECORATIVE ARTICLE AND METHOD FOR MAKING THE SAME

BACKGROUND OF THE INVENTION

1. Field of the Invention

The present invention relates to a decorative article and the method for making such decorative article, and in particular, to a method of making a three dimensional foam-filled decorative article which can be used for a wall hanging or other decorative purpose.

2. Summary of Related Art

Decorative articles in the arts and crafts industry have become especially popular in recent years. Craft shows and the making of decorative articles has become a major industry.

Decorative articles may be used as a stand-alone art work for wall hanging, or may be incorporated into a functional piece of furniture. The majority of art for wall hanging, such as paintings and poster art, are two dimensional pieces. Adding a third dimension to a decorative article provides a unique piece of art work which is distinguishable from the majority of paintings and similar art work.

Achieving a three dimensional effect is often difficult in a decorative article to be used as a wall hanging. The most attractive three dimensional decorative articles are often expensive to make and buy. In other cases, the three dimensional effect is present, but the results are not attractive from an artistic standpoint.

There is an opportunity and a need for a three dimensional decorative article which is reasonably inexpensive to design and build, and which is attractive from a art buyer's perspective.

Several different process are known for achieving a three dimensional effect for a decorative article. For example, U.S. Pat. No. 2,749,640 issued to Scott shows an ornamental article formed of a plurality of thermoplastic layers or sheets fused together in such a manner to form a design. The layers are fused along predetermined lines to form the desired three dimensional design.

U.S. Pat. No. 3,758,358 to issued Minoru Kuroda discloses a method of making a three dimensional foam-filled applique and an apparatus for carrying out the method. A foam material is places on a support. A layer of sheet material is superimposed upon the exposed surface of the foam material. The layer of sheet material is pressed against the support in a narrow area inwardly of the contour line. A latently adhesive material is activated to adhere the sheet material in a narrow zone to the support across the layer of foam material.

SUMMARY OF THE INVENTION

In accordance with the present invention, there is provided a decorative article and a means for making such a decorative article. The decorative article includes a wood base, a layer of polyethylene foam, batting, and a fabric outer surface.

In forming the decorative article of the present invention, a layer of polyethylene foam is adhered to a firm backing, such as plywood. A pattern is drawn or traced onto the outer surface of the foam. A number of smaller, pattern pieces are formed by cutting a number of slits in the foam along the lines of the pattern.

After the slits have been cut in the foam, the pattern pieces are covered to form the desired pattern. A layer of batting is used to provide a soft and fluffy texture to the decorative article. An outer layer made of interlock knit fabric or other similar fabric with the necessary elasticity is stretched over the various pattern pieces. Different colors may be selected for the knit fabrics used on various pattern pieces for the pattern. Instead of using different colored paints to achieve the desired color contrast in the article, different color knit fabrics are selected to provide the desired visual effect.

In selecting a foam material for forming the main surface of the article, the foam must have sufficient elasticity to permit the slits to be cut in the surface and then have the slits serve as a means for securing the batting and the knit material used to cover the pattern pieces. The knit material is pulled tight to provide a smooth surface for the finished article. The decorative article is divided into a number of pattern pieces to facilitate the stretching of the fabric and the smoothing of the outer surface.

The foam surface in the present invention must have sufficient elasticity to permit the insertion of the margins of the batting and knit material into the slits by a hand tool. After marginal edges of the batting and knit material have been inserted, the elasticity of the foam surface of the slit must permit the walls of the slit to close to secure the batting and knit material in the slit. The material can be mounted, stretched, and secured without any special fasteners or adhesives to secure the batting and the material.

In order to achieve a three-dimensional effect, the foam surface may be sculpted by cutting and trimming the foam. In addition, individual pieces of foam are sculpted to the desired shape and then are attached to the surface of the foam. Once the pattern pieces are positioned on the surface of the foam to achieve the desired three dimensional effect, the desired pattern is redrawn on the individual pieces of foam secured to the foam surface. Additional slits are cut around the three-dimensional pattern pieces prior to securing the batting and the material.

The batting and the material are stretched over the pattern pieces and secured in the slits by the elastic resistance of the foam walls of the slit. The different layers of foam provide the desired three dimensional effects. The material furnishes the different color schemes and texture to the final surface of the decorative article. Decorative items, such as beads, stones, and other jewelry-type items, may be attached to the material to provide a more decorative surface.

The present method provides a convenient and effective means for achieving a three dimensional effect. The finished product, when a number of different colors are used in the material, may provide an attractive and striking piece of art.

The decorative article is typically shown as a wall hanging. Various hanging means may be secured to the backing of the decorative article to facilitate the hanging of the article. The decorative article may also be combined with furniture pieces to provide a unique, decorative piece of furniture. The decorative article of the present invention has been incorporated into such furniture pieces as the head board of a bed, the lid of a clothes hamper, the sides of a toy box, and other similar applications.

An object of the present invention is to provide a three-dimensional decorative article that is relatively simple to make and decorate. The pattern formed on the decorative article may incorporate almost any type of scene. The means for securing the batting and material does not require significant strength or any special adhesives or other chemicals.

Another object of the present invention is to develop a decorative article which can be built by someone without any formal artistic training. Attractive and distinctive wall hangings may be built without requiring substantial art education or artistic skills

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
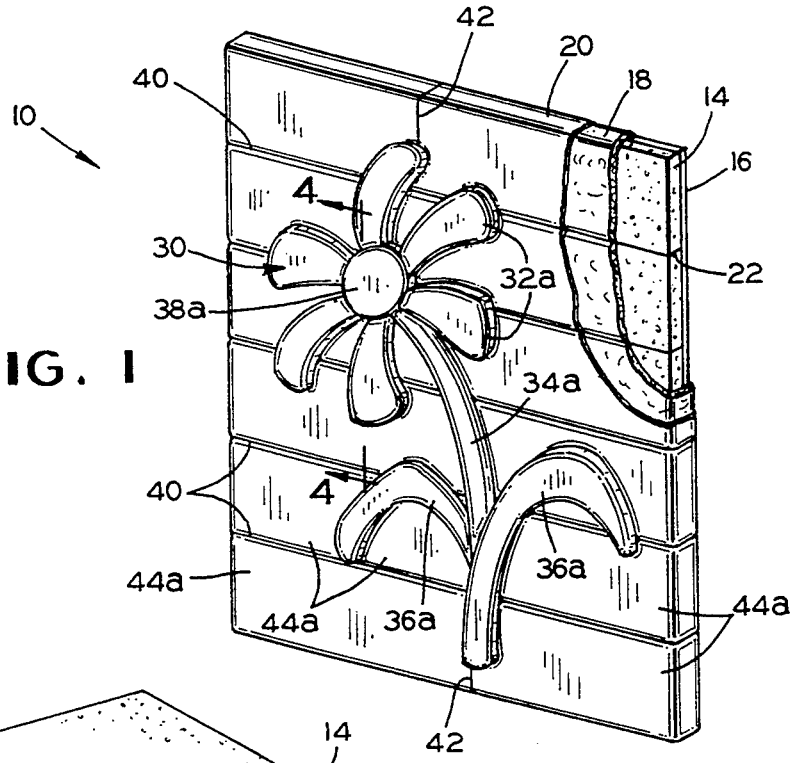
FIG. 1 is a perspective view with partial cut-away showing the decorative article of the present invention.
Figure 2:
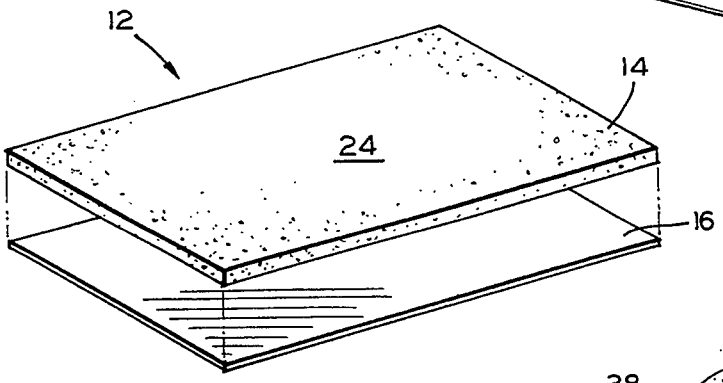
FIG. 2 is a perspective view of the polyethylene foam prior to attachment to the backing.

Referring now to the drawing, there is shown in FIG. 1 an example of the decorative article 10 of the present invention. In making the decorative article, there are the typical parameters which need to be determined at the outset of the project. The decorative article 10 may be built not only in the most common rectangular shapes, but also in circular, hexagonal, and irregular shapes.

Once the size of the decorative article 10 is determined, then the base 12 is formed by cutting the piece of foam 14 and the backing 16 to the desired size. The foam 14 and the backing 16 are glued together using a spray adhesive, or other similar adhesive, in a known manner.

The foam 14 must be of sufficient thickness to elastically retain the batting 18 and the knit material 20 in the slits 22 cut in the foam 14. A foam thickness of 1.0 to 1.5 inches provides sufficient retention elasticity in the slits 22. A polyethylene foam, such as "Polyplank" or "Ethafoam" is preferred over the more brittle polystyrene foam. The foam 14 must retain its general shape when cut, and must have sufficient elasticity to retain and secure the batting 18 and material 20 after the slits 22 have been wedged apart to insert such batting 18 and material 20 in the slits 22. The foam 14 could be made of other resilient materials which have the appropriate elasticity and characteristics for forming the desired shapes and cutting the necessary slits.

The backing 16 is provided to support the foam 14 and facilitate the mounting of the decorative article 10 on a wall. From a cost standpoint, plywood (0.25 inch thickness) is satisfactory for a backing 16. Other rigid materials may be used to form the backing 16. Hooks and hanging wire (not shown) may be attached to the back side of the backing 16 to facilitate the hanging of the decorative article 10.

Once the foam 14 is secured to the backing 16, the preparation of the front surface 24 is started. The first step, for which there are several options, is to place the desired pattern 26 on the front surface 24. A pattern 26 may be drawn free-hand on the front surface 24 of the foam 14. Transparencies may of the desired pattern 26 may be made and projected on the front surface 24. The pattern 26 is then traced on the front surface 24. An additional means for creating the pattern is to purchase a specific tracing pattern and trace the pattern 26 on the surface 24.

The types of patterns which may be used in this form of article is unlimited. Single objects, such as the flower 30 shown in FIG. 1, are relatively simple to complete. More complex nature scenes, wildlife, architecture, geometric design patterns, commercial objects, and other similar scenes are also suited for this type of artwork. In addition to creating a single object with a background such as shown in FIG. 1, the present invention may also be used to create a single object without background. In such a case, the base 12 is cut to the desired shape of the objects. For example, bases 12 may be cut in the shape of giraffes, bears, rabbits, ducks, and mice, and then be used to make decorative articles for decorating a nursery.

After the pattern 26 has been created on surface 24, the three dimensional effects are added. The three dimensional effects may be achieved by both trimming material from the front surface 24 of the foam 14 or by securing addition foam material to the front surface 24. In trimming the front surface 24, a sharp knife or razor blade may be used to cut small contours or patterned indentions into the front surface 24. The contoured and tapered edges are frequently used at an edge 28 of a three dimensional object to enhance the overall effect.

The additional foam material to be secured to the front surface 24 is shaped and formed into the desired configuration prior to attachment. The various pieces of material are made from the same type of foam material as used for the base foam 14. The additional foam material may be cut from foam sheets by tracing the specific area of the pattern 26 onto a sheet of foam for cutting, or may be cut free-hand from a pieces of foam of the approximate shape and size needed for the additional material. More than one additional layer of foam may be used to achieve the desired configuration.

Figure 3:
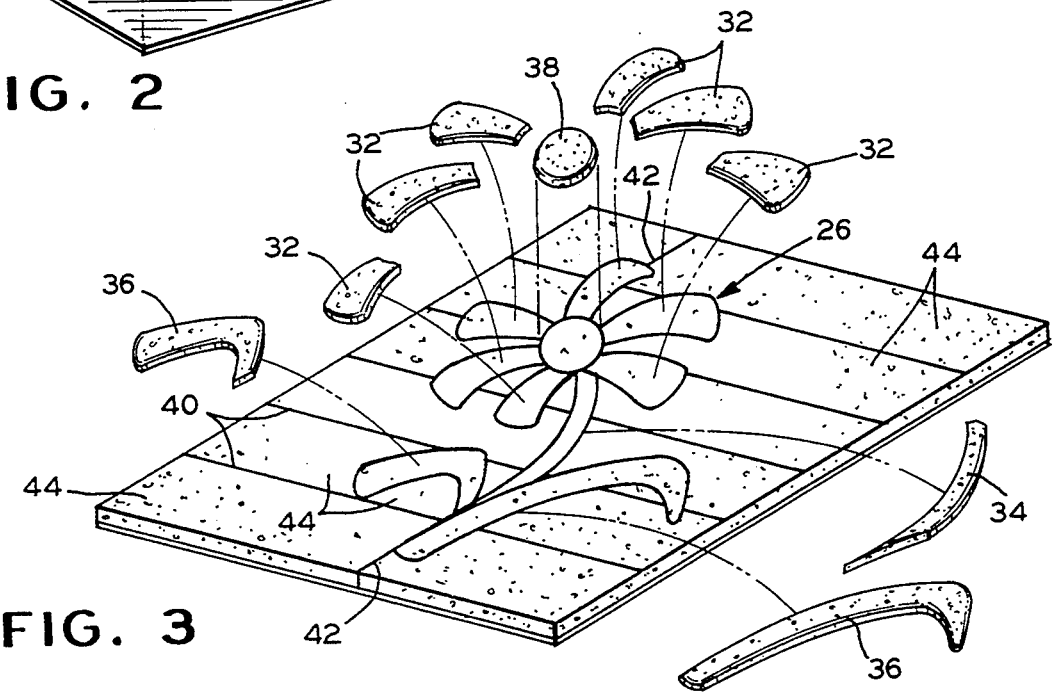
FIG. 3 is a perspective view of the foam surface showing the pattern tracing and the three dimensional pattern pieces.

FIG. 3 shows the additional material, including the petals 32, stem 34, leaves 36, and pistil 38 of the flower. After the additional foam material is cut to the desired shape for pieces 32, 34, 36, 38, the pieces are secured to the top surface 24 using a spray adhesive or other similar adhesive.

In cases where the pieces of additional foam material are adjacent to each other, it may be preferable to initially cut one piece of pattern foam for multiple adjacent pieces. After the pattern foam has been cut about the outer edge of the multiple pieces and secured to the outer surface 24, the individual pieces can be delineated by retracing or drawing the individual pieces on the pattern foam. Individual pieces of foam may also be used depending upon the convenience and preference of the artist.

Figure 4:
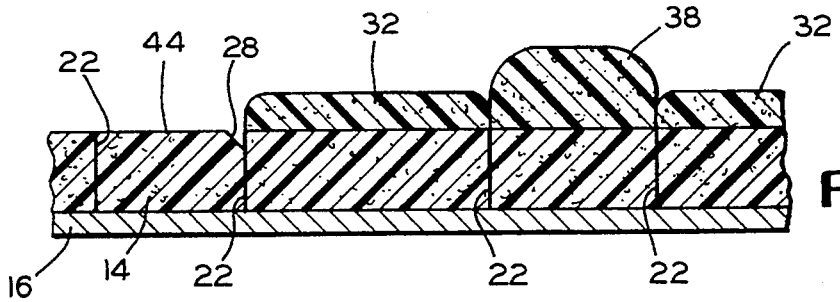
FIG. 4 is a cross-sectional view of the decorative article taken along line 4—4 in FIG. 1.

After the pieces 32, 34, 36, 38 of additional foam material have been secured to front surface 24, any final shaping may be completed prior to cutting the slits 22 to secure the batting 18 and the material 20. The pattern 26 may be retraced or redrawn as necessary to make sure the outlines of all of the individual pattern pieces are clearly shown for cutting purposes. FIG. 4 is a cutaway of the main flower 30 section showing the raised pistil 38 and the thinner flower petals 32 mounted on the foam 14.

The next step requires a knife or razor blade (not shown) to cut slits 22 into the foam 14 along the pattern 26. The slits 22 should be cut approximately 1.0 to 1.5 inches into the foam 14. When only a single layer of foam 14 is present, the slits 22 will typically be cut through to the backing 16. The slits must be narrow in order to retain sufficient elastic forces to retain the batting 18 and cloth 20 in the slits 22. A razor blade knife is the preferred tool for cutting the slits 22. In cases where there are significant areas on the front surface 24 without any pattern, horizontal background lines 40 may be cut into the foam 14. Vertical background lines 42 may occasionally be used to reduce the size of an especially large pattern piece. This reduces the size of the pattern pieces and makes it easier to install and retain the batting 18 and material 20 as desired.

Figure 6:
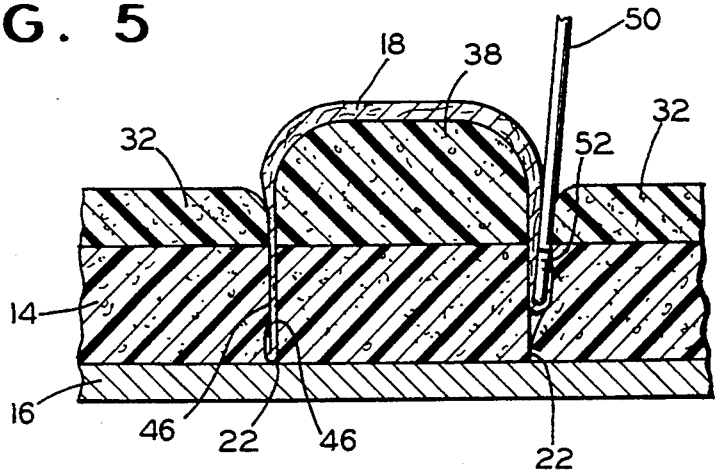
FIG. 6 is a cross-sectional view of the decorative article showing the insertion of the batting.
Figure 7:
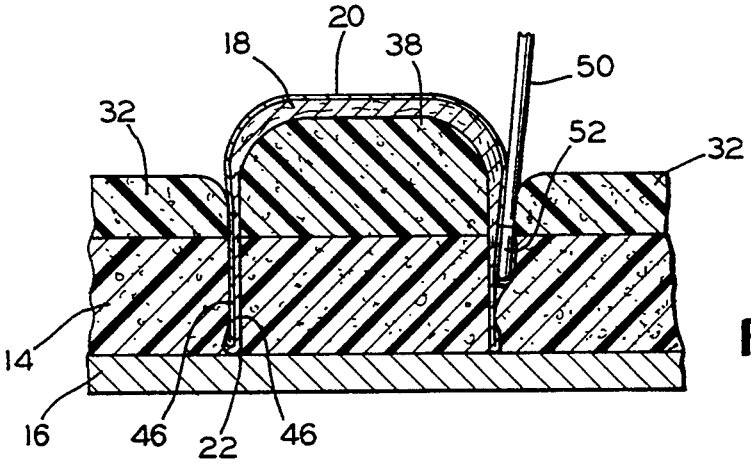
FIG. 7 is a cross-sectional view of the decorative article showing the insertion of the material.

The cutting of the slits 22 creates individual pattern pieces, which in FIG. 3 are defined by the flower pieces 32, 34, 36, 38 and the individual pieces of the background 44. Each pattern piece is fitted for a cover of batting 18 and material 20. The batting 18 and material 20 are cut to provide approximately a one to two inch margin around the outer circumference of the various pattern pieces. The margins on the batting 18 and the material 20 are then inserted into the slits 22 as shown in FIG. 6 for the batting and FIG. 7 for the material 22.

FIG. 1 shows the pieces of foam in FIG. 3 after the batting 18 and material 20 have been secured on the various pattern pieces. The covered pieces of FIG. 1 are designated by the same number as the uncovered pieces in FIG. 3 with a suffix "a" added in FIG. 1 to differentiate between the covered and uncovered piece.

The batting 18 is used to puff up each pattern piece and cushion the edges of the foam to prevent ripping of the material 20. A lofty batting is typically used in the present invention. The compressibility of the batting 18 assists in retaining the material 20 in the slits 22. The slits 22 are narrow and the insertion of the batting 18 requires the material 20 to be wedged into the slit 22. The batting 18 acts as an elastic liner on the faces 46 of the slit 22 and effectively transfers the elastic forces of the faces 46 to retain the material 20.

Figure 5:
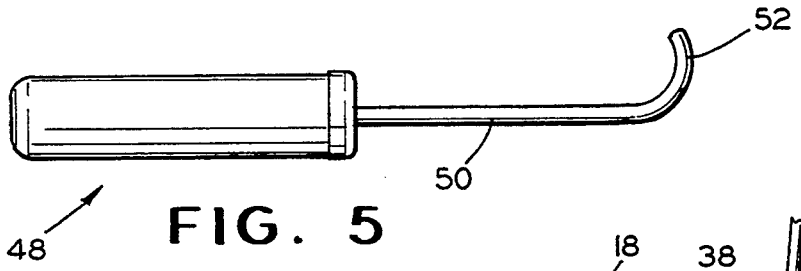
FIG. 5 is a side elevational view of the hand tool used to insert the batting and the material into the slits in the foam.

A means for inserting the batting 18 and material 20 into the slits 22 is required. FIG. 5 shows a tucking tool 48 with and extended shaft 50 and curved end 52. The tucking tool is used to wedge apart the faces 46 of the slit a sufficient distance to permit the backing 18 and then the material 20 to be inserted. When the tool 48 is removed from the slit 22, the walls 46 try to return to their original position. The walls have sufficient elasticity to retain the batting 18 and then the material 20 in the slit 22.

FIG. 6 shows the batting 18 being installed on the pistil 38. The tool 48 slides the margin of the batting 18 into the slit 22 between faces 46. When the tool 48 is withdrawn from the slit 22, the faces 46 move together to retain the batting 18. No glue or other adhesive is needed to retain the batting 18.

When inserting the piece of batting 18 cut for the pistil 38, the piece of batting is positioned on top of the foam piece for the pistil 38. The end 52 of the tool 48 is used to tuck the initial portion of the margin into the slit 22. The tool 48 may then be moved in either direction to continue tucking the margin of the batting 18 into the slit 22. The tool 48 is moved around the total circumference of the pistil 38 to tuck all of the margin in the slits 22. The artist using the tool 48 has one hand on the tool and the other hand positioning the batting 18 about the end of the tool 52 on the slit 22 for insertion. As the tool 48 completes the circumference of the pistil 38, the batting is stretched to ensure a smooth and tight cover on the outer surface of the petal 38. The material 20 is cut and installed in a similar fashion (see FIG. 7).

The batting 18 and the material 20 are cut and installed on the remaining pattern pieces in a similar fashion. The artist may also install all of the batting 18 first and then install the material 20.

The material 20 must be stretched to provide a smooth and taught surface. The preferred material for the outer material 20 is an interlock knit. The grain of the knit material 20 is typically maintained in the same direction for the decorative article 10. Knit material 20 is available in a wide variety of colors. The artist may mix and match colors as desired to achieve the proper effect for the decorative article 10.

Figure 8:
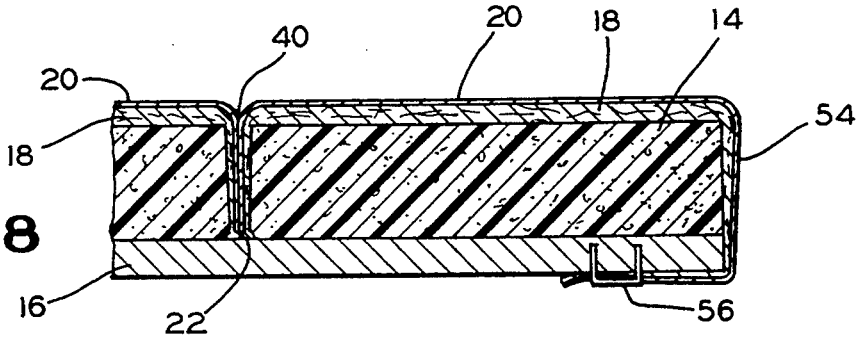
FIG. 8 is a cross-sectional view of one end of the decorative article showing the staple means for securing the outer edge of the batting and material.

After the batting 18 and material 20 have been inserted into the slits 22, the outer edges 54 of the decorative article must be secured. The margin for both the batting 18 and the material 20 must be long enough to stretch around the edge 54 to the backing 16, which is approximately 3 to 4 inches depending on the thickness of the foam 14 and the backing 16. The batting 18 and material 20 are pulled tight around the edge 54 and stapled to the backing 16 as shown in FIG. 8. Any excess batting 18 or material 20 may be cut off at the staple 56.

FIG. 8 also shows a slit 22 after the batting 18 and material 20 have been inserted. Since no glues or adhesives are required, the material 20 may be removed after the initial installation to change colors of material. The material 20 and batting 18 may also be removed to add additional foam to change the shape of the pattern piece. The batting 18 and material 20 may then be cut for the shape of the new piece. Such changes may be completed without having to remake the complete article 10. The ease of modification is another attractive feature of the present invention.

In order to increase the durability of the decorative article 10, the material 20 may be treated with a fabric protector, such as "Scotchguard" or other similar treatment.

Hooks and wires (not shown) may be attached to the backing 16 for hanging the decorative article 10. The backing 16 of the decorative article 10 may also be permanently attached to a surface or frame for displaying the decorative article.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for making a decorative article having a generally planar surface with a pattern formed thereon, said method comprising:

a) cutting a planar, elastic foam material in a desired peripheral shape for the planar surface of the decorative article, said foam material having a back surface, a front surface, and a peripheral edge;

b) cutting a rigid, light-weight, planar backing in the same peripheral shape as said foam material and securing said backing to said foam material;

c) drawing a pattern on the front surface of said foam material;

d) cutting a plurality of slits along the pattern in the front surface of said foam material such that the slits and the periphery of said foam material define peripheries for a plurality of pattern pieces in the foam material, said slits being cut generally perpendicular to the front surface of said foam material to form parallel, elastic walls for each of said slits;

e) cutting pieces of batting in the same pattern as each of the pattern pieces, said pieces of batting provided with an extended margin for securing the pieces of batting atop said pattern pieces;

f) positioning the pieces of batting on the entire front surface of said foam material to cover the respective pattern pieces such that the margins of said pieces of batting are adjacent a slit or the periphery of said foam material, applying a force to separate the elastic walls of said slits in said foam material, simultaneously inserting the adjacent margins of the batting into corresponding slits, and removing the force on the elastic walls to secure the batting between the elastic walls of said slits;

g) cutting pieces of cloth material in the same pattern as each of the pattern pieces, said pieces of cloth material provided with an extended margin for securing the pieces of cloth material atop said batting pieces and said pattern pieces;

h) positioning the pieces of cloth material on the entire front surface of said foam material to cover the respective pieces of batting and pattern pieces such that the margins of said pieces of cloth are adjacent a slit or the periphery of said foam material, applying a force to separate the elastic walls of said slits in said foam material, simultaneously inserting the adjacent margins of the cloth material into corresponding slits, and removing the force on the elastic walls to secure the cloth material between the elastic walls of said slits; and i) stretching the margins of the batting and the cloth material which are adjacent the periphery of said foam material around the peripheral edge of said foam material and securing the margins to a back surface of said backing.

2. A method for making a three-dimensional decorative article having a generally planar surface with a three-dimensional pattern formed thereon, said method comprising:

a) cutting a planar, elastic foam material in a desired peripheral shape to form a planar base of the decorative article, said foam material base having a back surface, a front surface, and a peripheral edge;

b) cutting a rigid, light-weight, planar backing in the same peripheral shape as said foam material base and securing said backing to said foam material base;

c) drawing a pattern on the front surface of said foam material base;

d) cutting individual sections of foam material from a second piece of foam material and adhesively securing said individual foam material sections to the front surface of said foam material base in selected areas of the pattern to define a three dimensional front surface;

e) redrawing portions of the pattern covered by the individual foam material sections;

f) cutting a plurality of slits along the pattern in the front surface of said foam material such that the slits and the periphery of said foam material base define peripheries for a plurality of pattern pieces in the foam material base and sections, said slits being cut generally perpendicular to the front surface of said foam material base to form parallel, elastic walls for each of said slits;

g) cutting pieces of batting in the same pattern as each of the pattern pieces, said pieces of batting provided with a margin extending beyond the peripheries of said pattern pieces;

h) positioning the pieces of batting on the respective pattern pieces formed by the foam material base and the individual foam material sections to cover the pattern pieces such that the margins of said pieces of batting are adjacent a slit or the periphery of said foam material base, applying a force to separate the elastic walls of said slits in the foam material, simultaneously inserting the adjacent margins of the batting into corresponding slits, and removing the force on the elastic walls to secure the batting between the elastic walls of said slits;

i) cutting pieces of cloth material in the same pattern as each of the pattern pieces, said pieces of cloth material provided with an extended margin for securing the pieces of cloth material atop said batting pieces and said pattern pieces;

j) positioning the pieces of cloth material on the respective pattern pieces to cover the pieces of batting secured to the pattern pieces such that the margins of said pieces of batting are adjacent a slit or the periphery of said foam material base, applying a force to separate the elastic walls of said slits in the foam material, simultaneously inserting the adjacent margins of the cloth material into corresponding slits, and removing the force on the elastic walls to secure the cloth material between the elastic walls of said slits; and k) stretching the margins of the batting and the cloth material adjacent the periphery of said base around the peripheral edge of said foam material base and securing the margins to a back surface of said backing.

3. The method of making a decorative article defined in claim 2 wherein said foam material is a polyethylene foam material.

4. The method of making a decorative article defined in claim 2 wherein said cloth material is an interlock knit cloth material.

5. The method of making a decorative article defined in claim 2 wherein cutting individual sections of foam material includes attaching a multi-layer of individual sections of foam material to the front surface of the foam material base to enhance the three-dimensional effect.

6. The method of making a decorative article defined in claim 2 including the step of sculpting the front surface of the foam material base and the individual sections of foam material to achieve the desired three-dimensional pattern.

7. The method of making a decorative article defined in claim 2 including the additional step of stretching the cloth material while simultaneously inserting the cloth material into said slits to provide a smooth and taut outer surface of cloth material.

8. The method of making a decorative article defined in claim 2 including the step of trimming the pieces of batting and the pieces of cloth material positioned along the periphery of the foam material base immediately prior to securing the margins of the batting and the cloth material to a back surface of said backing.

* * * * *